United States Patent [19]

Langen et al.

[11] 4,342,808

[45] Aug. 3, 1982

[54] ROLL STOCK FOR USE IN MANUFACTURE OF BAG

[75] Inventors: Marinus J. M. Langen, Rexdale; Edgar H. Strauss, Toronto, both of Canada

[73] Assignee: H. J. Langen & Sons Limited, Mississauga, Canada

[21] Appl. No.: 124,338

[22] Filed: Feb. 25, 1980

Related U.S. Application Data

[63] Continuation of Ser. No. 969,409, Dec. 14, 1978, abandoned.

[51] Int. Cl.[3] ..... B32B 3/02; B32B 29/00

[52] U.S. Cl. ..... 428/194; 428/189; 428/211; 428/212; 428/906

[58] Field of Search ..... 428/194, 211, 906, 913, 428/189, 212; 427/208.6, 208; 156/290, 291

[56] References Cited

U.S. PATENT DOCUMENTS

| | | | |
|---|---|---|---|
| 2,096,351 | 10/1937 | Semonsen | 428/194 |
| 2,503,680 | 4/1950 | Newman . | |
| 2,589,202 | 3/1952 | Newman . | |
| 3,138,476 | 6/1964 | Phipps | 427/208 |

*Primary Examiner*—Paul J. Thibodeau

*Attorney, Agent, or Firm*—Fetherstonhaugh & Co.

[57] ABSTRACT

Roll stock specifically designed for use in making a paper bag using automatic bag making machinery is provided wherein a first pair and a second pair of bands of adhesive material of a type which is inactive to form a bond until placed in contact with an adhesive of the same type are applied to the inner and outer faces of the web adjacent said edges thereof. The bands of the first pair are laterally spaed with respect to the bands of the second pair so as to be out of alignment with one another in successive turns of the roll stock such that the successive turns are not adhesively secured to one another. An empty square bottom bag is provided which consists of a front wall, a back wall and a bottom wall formed from a unitary panel and including a band of adhesive on the outer face of said panel extending along the marginal edge portion of each side panel, the panels being folded inwardly so that the band of adhesive on one side panel is disposed at an interface with another side panel and thereby secures the side wall panels with respect to one another in an overlapping relationship to close opposite sides of the bag and retain front, bottom and back walls in an open U-shaped configuration.

2 Claims, 19 Drawing Figures

FIG. 1
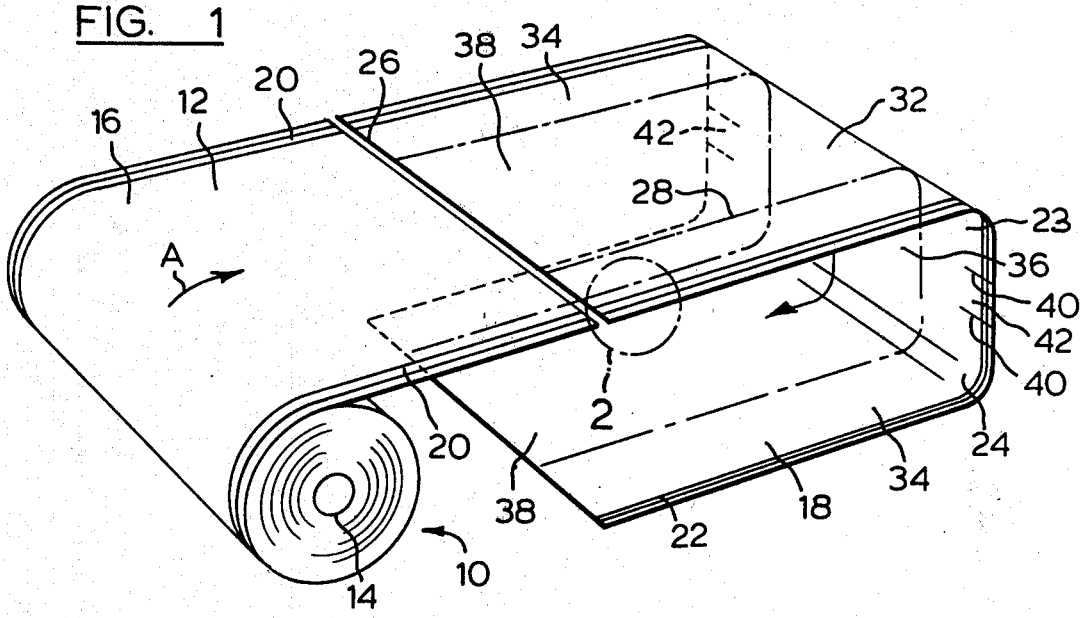
FIG. 2
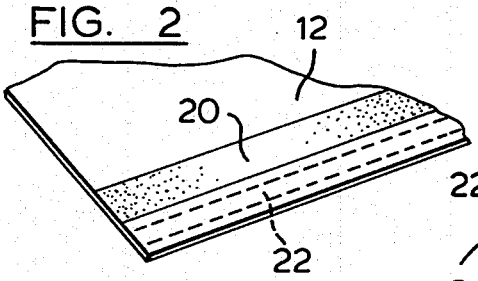
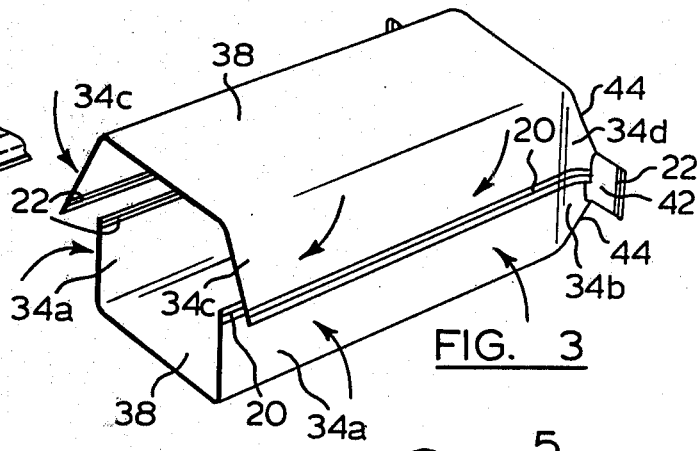
FIG. 3
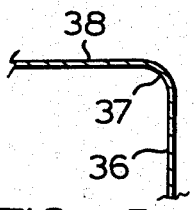
FIG. 5
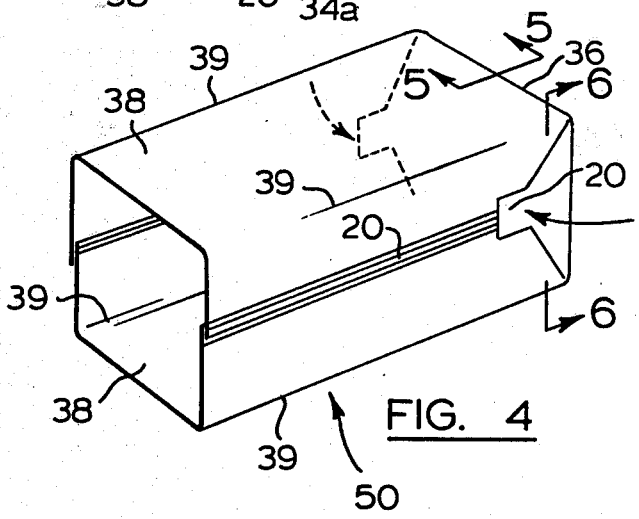
FIG. 4
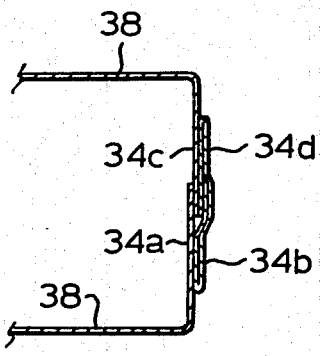
FIG. 6

ROLL STOCK FOR USE IN MANUFACTURE OF BAG

This disclosure is a continuation of application Ser. No. 969,409, filed Dec. 14, 1978 having the same title, now abandoned.

FIELD OF INVENTION

This invention relates to the manufacture of square bottom bags.

Various aspects of this invention relate to improvements in roll stock for manufacturing the bag, improvements in a bag structure, improvements in a method of forming a bag and a new bag forming machine.

These various aspects of the present invention are particularly suitable for use in the manufacture of paper bags.

PRIOR ART

In the manufacture of bags such as paper bags, it is customary for the bag to be manufactured by a bag manufacturer and shipped to the user in a knocked down configuration. Despite the fact that the bags are shipped from the manufacturer in a knocked down configuration, the bulk of the bags after manufacture is generally substantially greater than the bulk of the original roll stock from which the bags are manufactured. This results in large part from the various multiple folds which are formed in the bag. Thus, the problems associated with the shipping and storing of bags in the knocked down configuration is greater than that experienced with the shipping and storing of roll stock in the form of a coil.

During the manufacture of square bottom paper bags by the conventional bag forming apparatus, the roll stock is creased to form a tubular member having inwardly directed side gusset panels. In the forming of the bottom of the bag, a complex series of creases are formed. Each crease is formed so that the paper stock will be permanently set at the crease line. To achieve this permanent crease, it is necessary to damage some of the fibers at each crease line. This has the effect of weakening the bag along each crease line. In the conventional manufacture of bags, it is necessary to form crease lines extending transversely across the bottom of the bags in order to locate the bags in the lay-flat configuration. Thus, in forming weakened crease lines extending across the bottom of the bag, the bag is automatically weakened at the point where it is subjected to maximum load, namely the crease line between the bottom panels and side panels.

Panels are produced in the knocked down configuration so as to be compact for shipping and storage as described above and the various creases which are formed implant a memory on the structure which will tend to return the bag structure to the laydown configuration when the bag is unsupported. As a result, when a bag is opened it is necessary to provide a retaining means of some type for retaining the bag in the open configuration to prevent it from returning to its lay-flat configuration. Because the bag always tends to return to its lay-flat configuration, it is difficult for the users, such as packers in a grocery store, to handle the bags during the bag loading operation. For this reason several devices have been previously proposed for use in mechanically opening knocked down bags and retaining them in the open configuration. These mechanisms have not, however, enjoyed any degree of commercial success and the reason for this is believed to be the inherent difficulty in engaging the opposite walls of a bag and moving them to the open position and holding them in the open position.

The conventional square bottom bag is formed from a single web of paper or the like which is folded upon itself to a tubular sleeve configuration with longitudinal side gussets. The bottom of the bag is formed by a complex series of folding and gluing operations and, as previously indicated, the bottom of the bag is inherently weakened by the various folding and creasing operations to which it is subjected. Furthermore, the side gussets tend to draw the front and back walls of the bag towards one another even when the square bottom is formed, making it difficult to obtain access to the bag without holding the free end in the open configuration.

While it is customary to manufacture bags from roll stock, the adhesive which is applied in the manufacture of a bag is generally applied during the manufacture of the bag in the bag making machine. The forming of the bottom closure of a bag in the conventional bag making machine is so complex that the individual skilled in the art would not consider attempting to apply adhesive to the web in the roll stock because of difficulties in attempting to register the various areas to which adhesive is applied when constructing the bottom. Furthermore, one would not normally consider applying an adhesive to a web of roll stock because of the risk of bonding the adjacent turns of the roll to one another.

The existing bag forming machines are large and complex and expensive. The machines are specifically designed to convert roll stock to bags which are discharged in a lay-flat configuration The machines have many moving parts and are designed to operate at high speed. The machines of the prior art are specifically designed to form the complex square bottom structure of a bag and to fold and crease the web so that the bag which is formed thereby will retain the lay-flat configuration in which it is discharged.

SUMMARY OF INVENTION

It is an object of the present invention to provide an improved method of forming a square bottom bag.

According to one aspect of the present invention, a method of forming a bag from a bag forming section of a web of bag forming material which has a length in a first direction and a width in a second direction at right angles to said first direction and which includes a main panel extending in said first direction and bounded on either side by a side closure forming panel comprising the steps of bending said web upon itself across its width to an open U-shaped configuration in which said main panel forms unitary, serially connected, front bottom and back walls which are closed in the configuration which they will assume when said bag is open, supporting said main panel in said open U-shaped configuration, folding said side closure forming panels toward one another to an overlapping relationship and securing said closure forming panels with respect to one another in said overlapping relationship to form side walls of a bag.

It is a further object of the invention disclosed herein to provide an improved square bottom bag.

According to a further aspect of the present invention, a square bottom bag comprises a front wall, bottom wall and back wall formed from a unitary panel and arranged in an open U-shaped configuration, first, second and third side panels projecting from opposite sides of said front, bottom and back walls respectively, said first, second and third side wall panels being folded inwardly and secured with respect to one another in an overlapping relationship to close opposite sides of said bag and retain said front, bottom and back walls in said open U-shaped configuration.

It is yet another object of the present invention to provide an improved roll stock for use in the manufacture of square bottom bags.

According to yet another aspect of the present invention, a roll stock for use in manufacturing a square bottom bag comprises a longitudinally elongated web of bag forming material having an inner face and an outer face, a pair of oppositely disposed side edges and a marginal edge portion extending inwardly from each of said side edges, said web being wound into a roll with said inner and outer faces aligned and in face to face contact with one another, a first pair and a second pair of bands of adhesive material of a type which is inactive to form a bond until placed in contact with adhesive with the same type, one of said pairs of adhesive bands being applied to said inner face and the other pair being applied to said outer face of said web, one band of each pair being located at each marginal edge portion, the bands of said first pair being laterally spaced with respect to the bands of said second pair so as to be out of alignment with one another in successive turns of said roll such that the successive turns of said roll are not adhesively secured to one another.

It is a further object of the present invention to provide an improved bag forming machine for manufacturing square bottom bags.

According to a further aspect of the present invention, a bag forming machine for manufacturing square bottom bags from an elongated web of bag forming material having a first portion extending longitudinally thereof from which the front, bottom and back walls of a bag are produced, said first portion being bounded on either side by co-extensive side wall forming portions comprising a frame, support means carried by said frame and positioned to support said first portion of a web in an open U-shaped configuration with said side wall forming portions projecting laterally from said support means, guide means supported by said frame and adapted to guide a web along the U-shaped guide path extending around said support means to the required configuration of the front, bottom and back walls of an open bag, drive means arranged to drive said web longitudinally of itself along said guide path to form the web to the open U-shaped configuration of the guide means, folding means mounted at either side of said support means for movement relative to said support means to engage and hold the side wall forming portions of a web inwardly toward one another into an overlapping relationship, means for sealing the overlapping portions of said side wall forming portions to close the sides of a bag in use, means at the input end of said guide means for severing a bag forming length from said elongated web, and discharge means for engaging a bag after forming for discharging the formed bag from said machine in an open configuration.

BRIEF DESCRIPTION OF DRAWINGS

The invention will be more clearly understood after reference to the following detailed specification read in conjunction with the drawings, wherein FIG. 1 is a pictorial view illustrating a first step in the forming of a square bottom bag from roll stock;

FIG. 2 is an enlarged detail of the portion of the web to FIG 1;

FIG. 3 is a pictorial view illustrating the folding of the sides of the bag inwardly upon one another;

FIG. 4 is a pictorial view similar to FIG. 3 showing a bag in the form in which it is discharged from the bag forming machine in an erect configuration;

FIG. 5 is a sectional view along the line 5—5 of FIG. 4;

FIG. 6 is a sectional view along the line 6—6 of FIG. 4;

Figures 9, 9A, 9B, 9C:
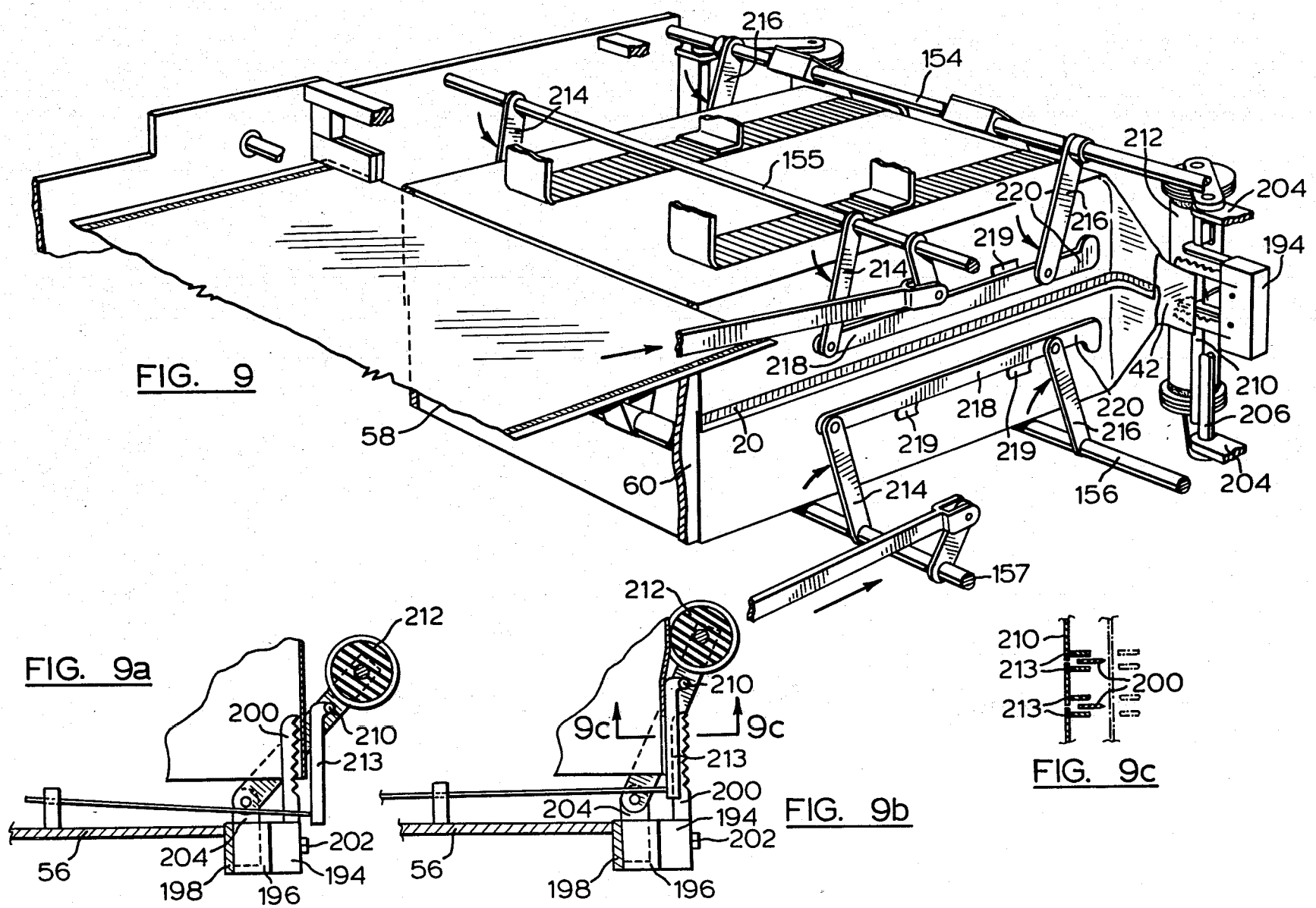
FIG. 9 is a view similar to FIG. 8 showing a first step in the closure of the sides of the bag around the former.
Figure 10:
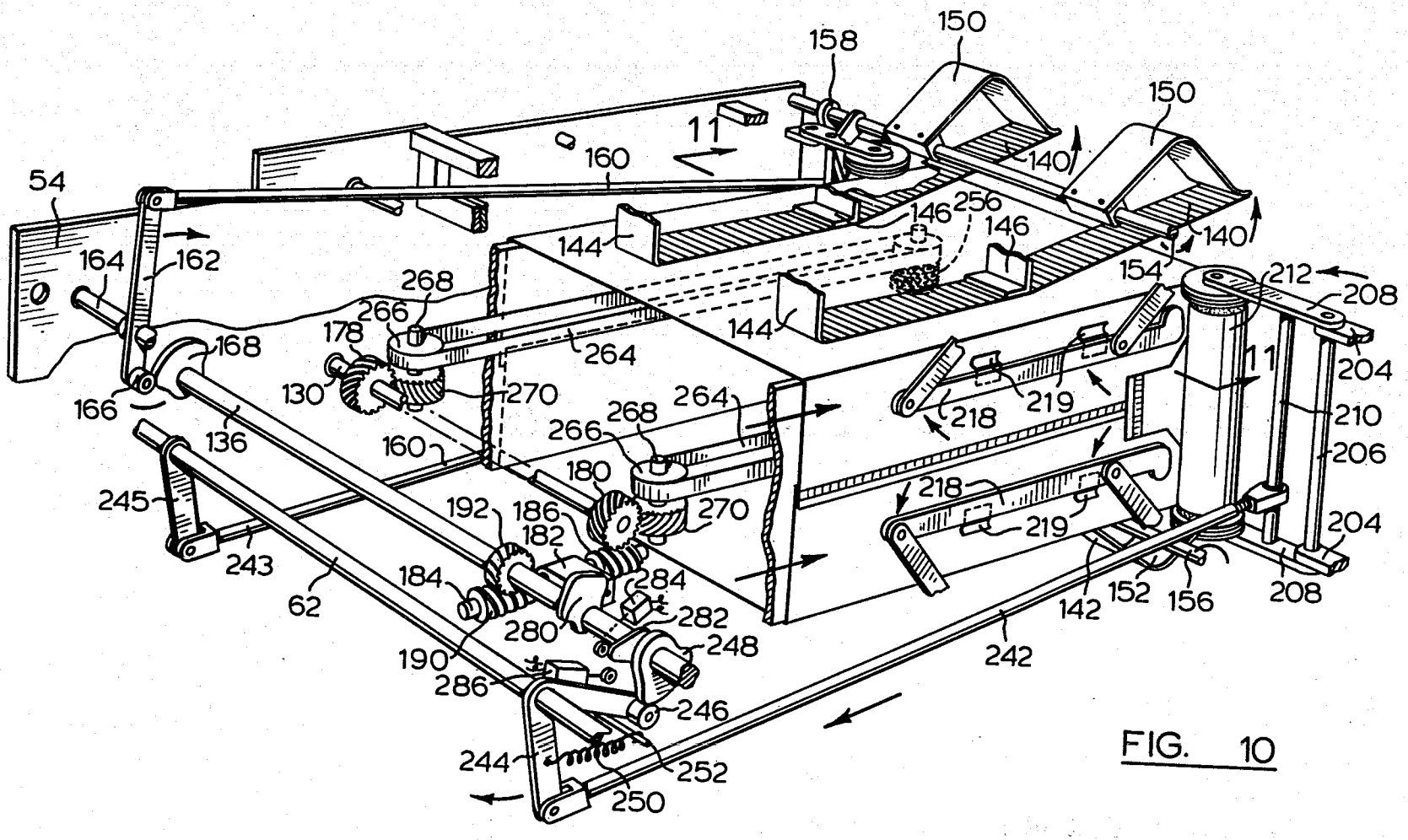
Figure 11:
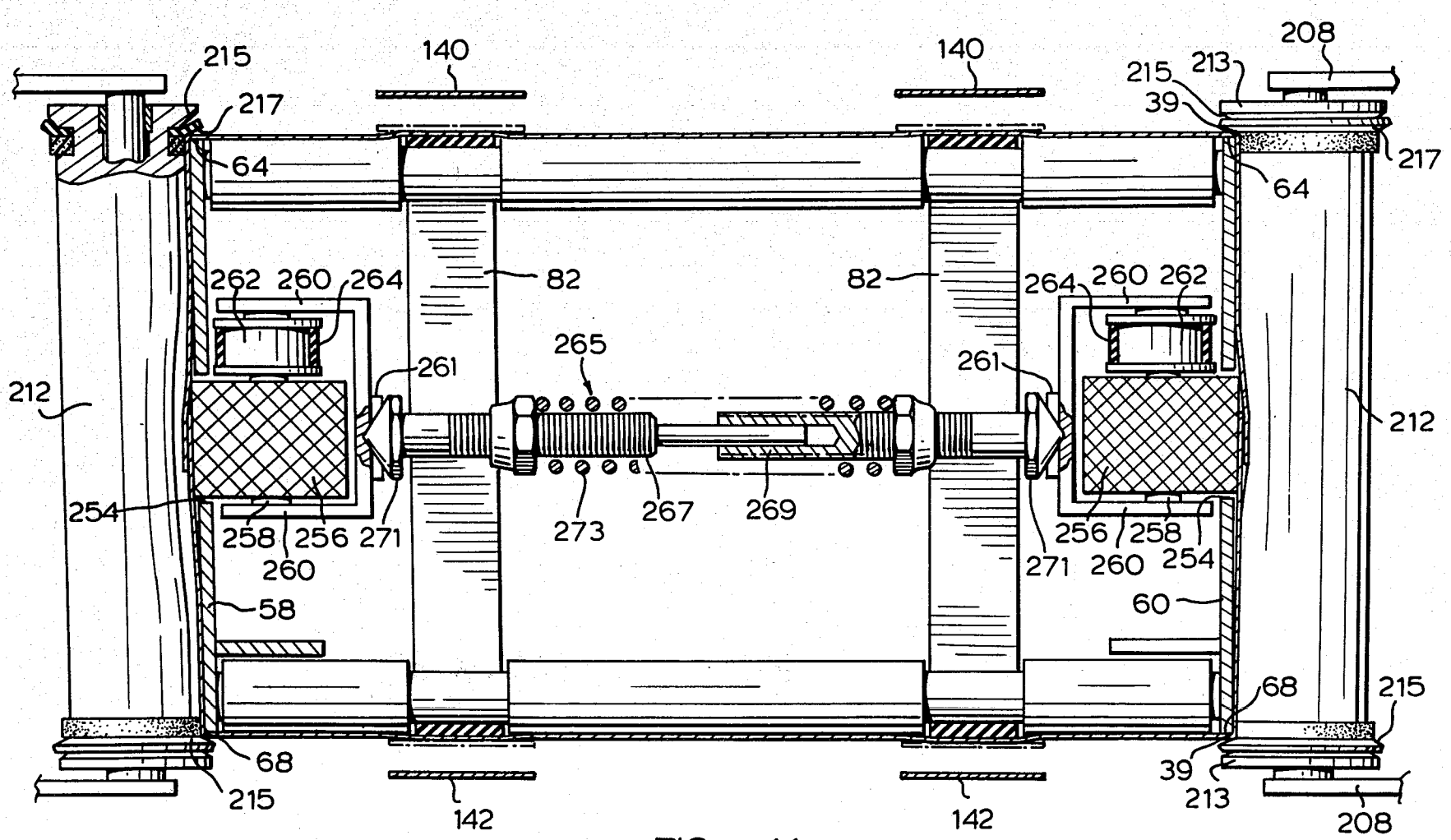
Figure 12:
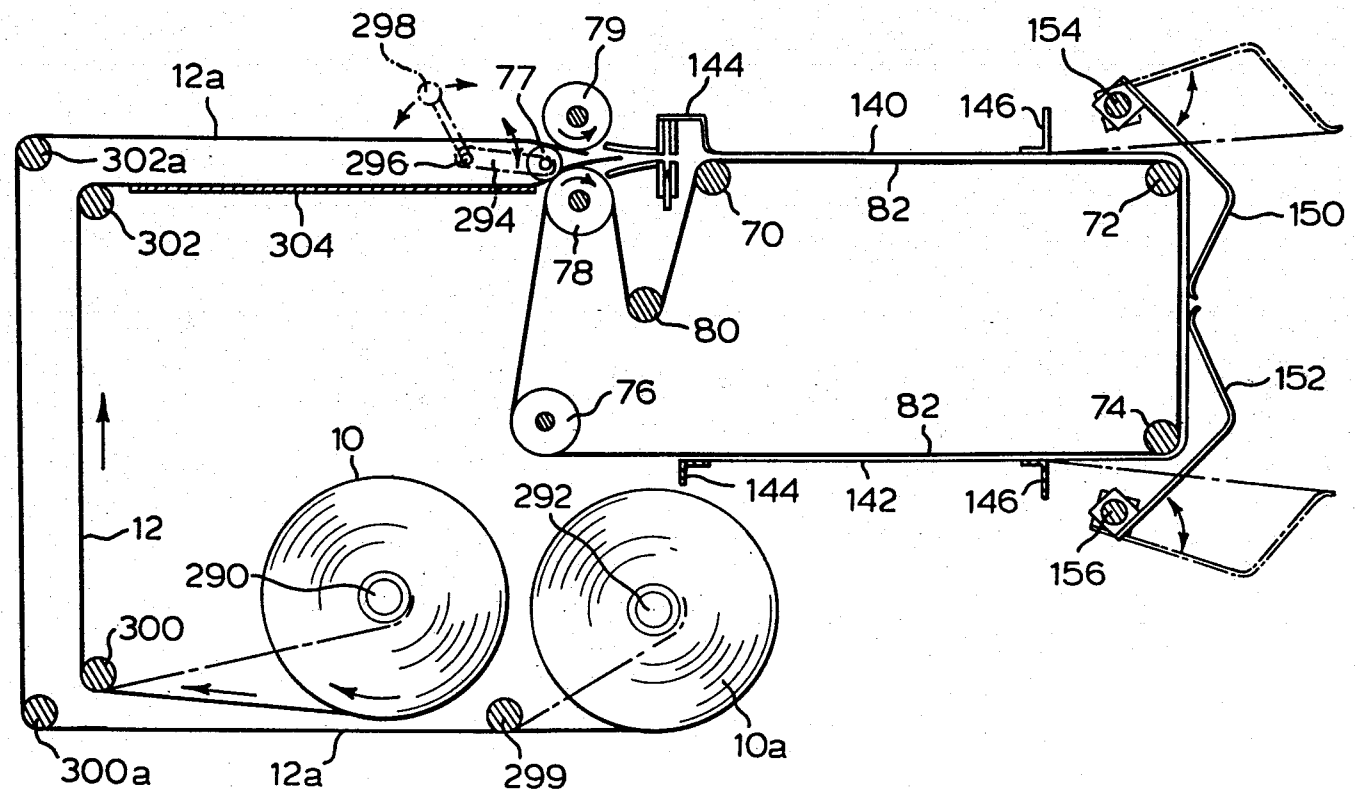
Figure 13:
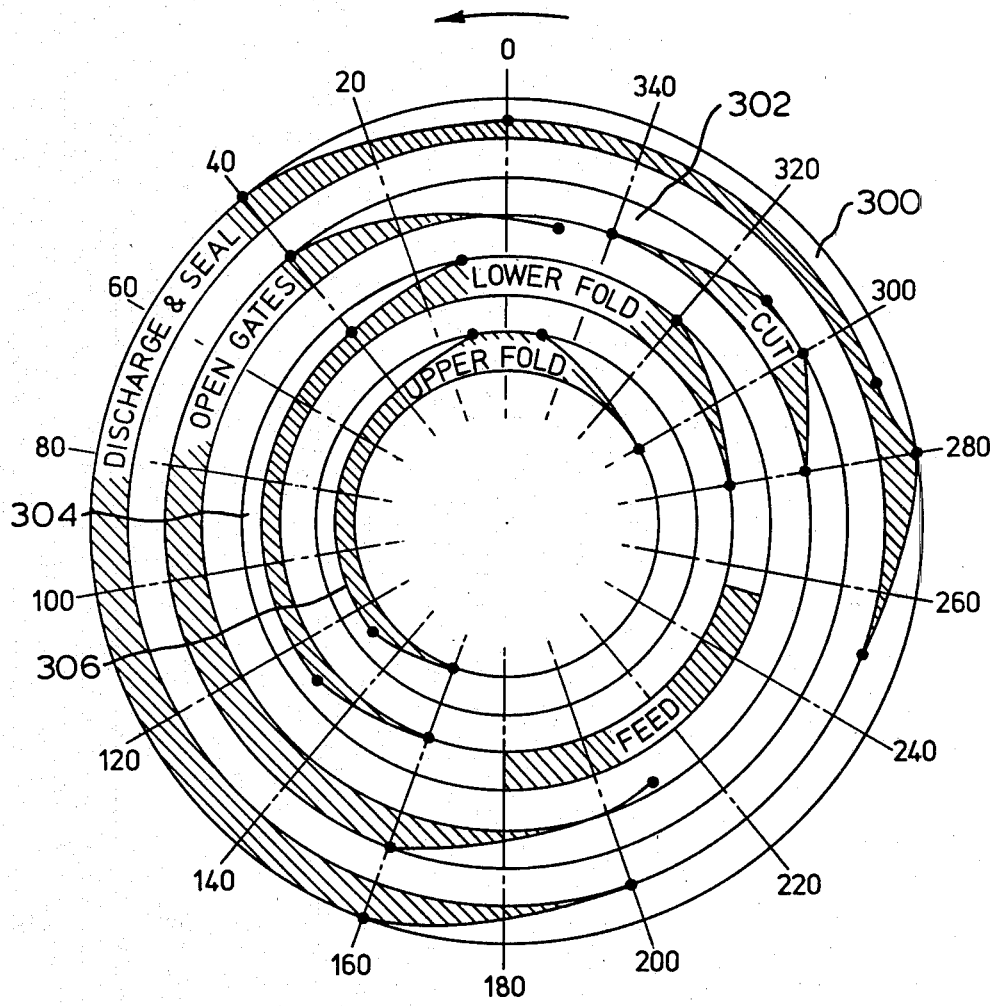
Figure 14:
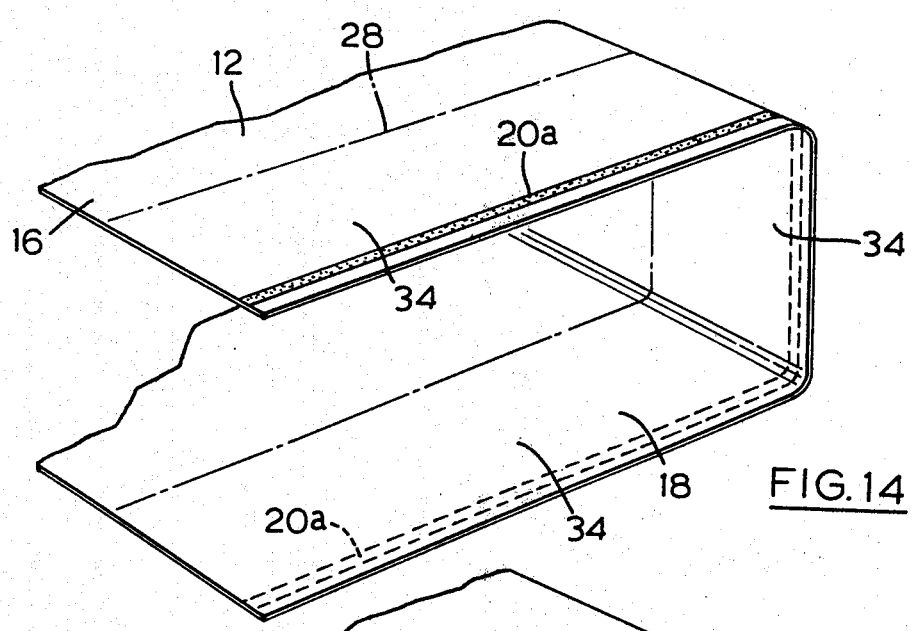
Figure 15:
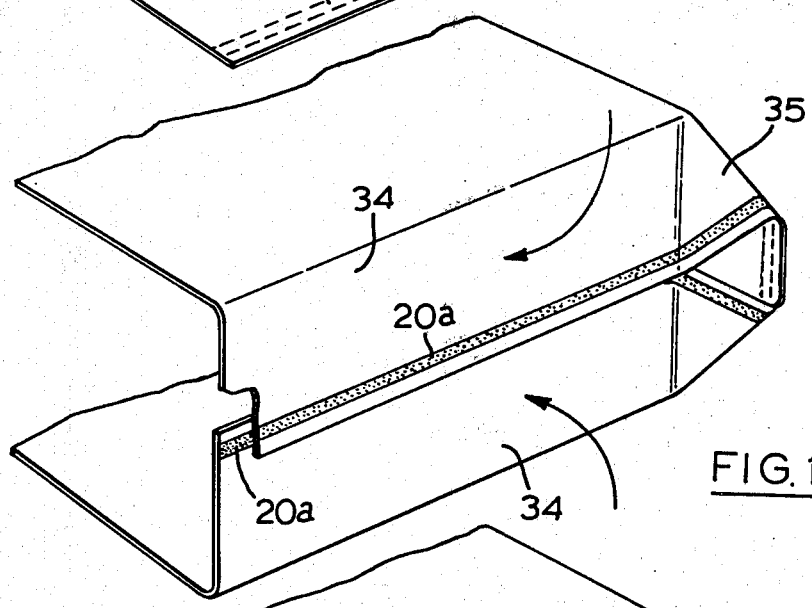
Figure 16:
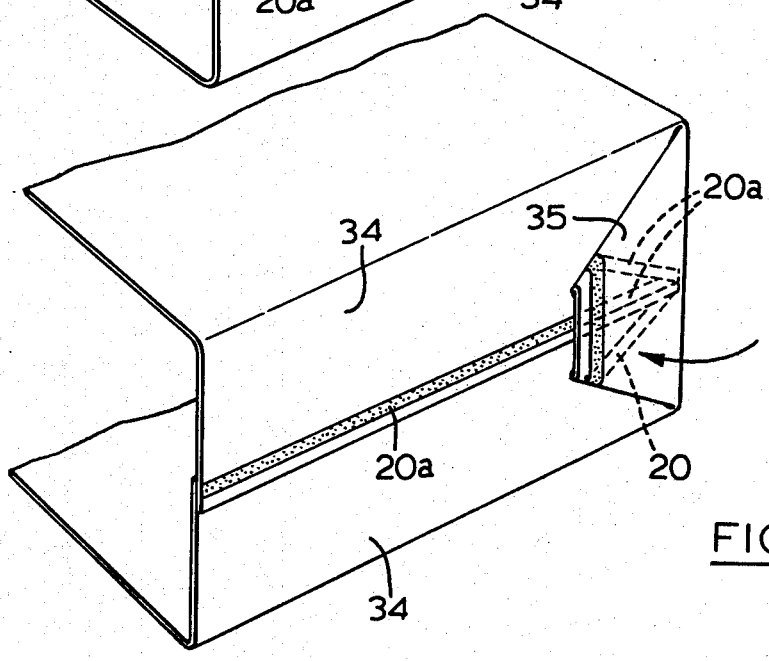

FIGS. **9*a* and 9*b*** are partially sectioned views illustrating the mechanism for severing the web to form an anchor tab on the side portions projecting from the bottom wall of the web;

FIG. **9*c* is a sectional view taken along the line 9*c* of FIG. 9*b***;

FIG. 10 is a view similar to FIG. 9 illustrating the apparatus moving to the position to permit discharge of the bag therefrom in the open configuration;

FIG. 11 is a sectional view along the line 11—11 of FIG. 10;

FIG. 12 is a diagrammatic sectional side view of a bag forming machine of the present invention showing the two positions of the flexible guide belts and the mounting of two rolls of paper stock;

FIG. 13 is a diagram illustrating the timing of the various functions of the apparatus;

FIG. 14 is a pictorial side view of a bag forming length of web similar to FIG. 1 illustrating a modification in the form of an alternative type of sealing means;

FIG. 15 is a pictorial side view showing the manner in which the side wall forming portions of the member of FIG. 14 are folded inwardly to overlapping position; and FIG. 16 is a view showing the folding of the end flap of FIG. 15 inwardly upon the side walls to the closed position.

FIGS. 1 to 6 of the drawings serve to illustrate a method of making a bag, a bag structure and a roll stock for use in making a bag in accordance with various aspects of the present invention.

ROLL STOCK

In FIG. 1 of the drawings, the reference numeral 10 refers generally to a coil of a material such as paper suitable for use in the manufacture of a paper bag. The coil 10 consists of a continuous web 12 which is wound around a core 14. The web is of uniform thickness and has an outer surface 16 and an inner surface 18. A continuous band of adhesive 20 is located on the upper surface 16 in a band which is spaced laterally inwardly from each side edge of the web. A band 22 of a similar adhesive is applied to the inner face 18 in a continuous band which is located between each side edge of the web and its associated band of adhesive 20. The adhesive bands 20 and 22 are laterally spaced from one another so that they do not come into contact with one another when the web is wound upon itself in the coil form. The adhesive is of a type which will not bond to the material from which the web is manufactured but will bond to another layer of the same adhesive such that if the adhesive in the band 20 is placed in contact with adhesive in a band 22, a bond will be formed therebetween. As shown in FIG. 2, the adhesive bands 20 may be substantially wider than adhesive bands 22.

The use of roll stock of the type described above is important in the manufacture of bags according to the method of the present invention as it serves to eliminate the need to have the manufacturer of the bag apply any adhesive to the web during the manufacture of the bag.

By the simple expedient of laterally displacing contact adhesives applied to the inner and outer surfaces of a roll of bag forming stock, it is possible to eliminate adhesive applying mechanisms from a bag making machine and this has the advantage of simplifying the mechanism which is required and simplifying the method of operation of the bag forming machine. By reason of the fact that the adhesive material is pre-applied to the web, it is not necessary to include a holding time in the cycle of operation sufficient to permit curing of the adhesive. The contact adhesive which is pre-applied to the web is such that a bond may be made between the bands of adhesive which are placed in contact with one another merely by pressing the bands one against the other with no need to effect a curing of the bond before releasing the compressive forces applied thereto to effect the bond.

A Co-Adhesive suitable for use in accordance with the present invention is manufactured by Findlay Inc. and sold under the trade mark NIPWELD 207-939. Other similar co-adhesives are available from Industrial Adhesives Limited and sold under the trade name L3108.

Method of Forming Bags

As shown in FIG. 1 of the drawings, the web 12 is unwound from the coil 10 and is driven in the direction of the arrow A. The unwinding end is driven along a U-shaped guide path as will be described hereinafter in detail with reference to the apparatus. As the web is guided along the U-shaped guide path, it is caused to bend upon itself around a first rounded corner in the area 23 and thereafter around a second corner in the area 24. It is important to note that, while the web is caused to bend, it is not creased so that no transverse crease lines are formed which will serve to weaken the web as a result of the bending of the web to the U-shaped configuration illustrated in FIG. 1. The required length of web to form one bag is then severed from the roll along the line 26. The broken lines 28 appearing in FIG. 1 of the drawings serve to separate the panel 32 which forms the main panel of the web from the side closure forming portions 34.

The main panel 32 consists of a bottom wall panel 36 and oppositely disposed front and back wall panels 38. The side wall forming portions which project from the bottom wall panel 36 are cut along lines 40 to form tabs 42.

As shown in FIG. 3 of the drawings, the side wall forming portions 34*a* which project from the panel 38 are folded inwardly and, as a result of inward folding, the portion 34*b* which projects from the bottom wall 36 folds along a fold line 44 which extends from the base of the tab 42 to an adjacent corner of the bottom wall panel 36. In the next step of forming the bag, the side wall forming portions 34*c* are folded inwardly and again the portion 34*d* folds along a fold line 44 extending from the base of the tab 42 to an adjacent corner of the bottom wall. When the side wall forming portions 34*c* are folded inwardly, the adhesive bands 22 which are located on the inner face thereof are placed in face to face contact with the adhesive band 20 on the exterior surface of the side wall forming portions 34*a* and are pressed together to form a permanent bond therebetween. Similarly the portions 34*b* and 34*d* and the tab 42 are folded into a face-to-face relationship with the remainder of the side walls as shown in FIG. 4 and are secured in the folded position by reason of the fact that the adhesive band 20 is folded upon itself and is thereby bonded to itself and the adhesive band 22 of the inner face of the tab 42 is placed in contact with a portion of the underlying adhesive band 20.

In FIG. 4 of the drawings, the reference numeral 50 refers generally to a paper bag constructed as described above. It will be noted that the bottom wall 36 and front and back walls 38 of the bag are formed from a continuous web and, as shown in FIG. 5, the corner 37 formed between panels 36 and 38 is rounded so that the bottom is not weakened by the bending of the web in the forming of the web to the U-shaped configuration.

It will be noted that none of the steps described above in the formation of the bag are such that the bag is creased or folded in any way which would tend to encourage movement of the bag to a knock-down configuration. As will be described hereinafter, a crease may be formed along the longitudinal side edges 39 which will serve to retain the bag in the open configuration when it is removed from the former on which it is formed. Thus, the bag constructed in the manner described above has no "memory" of any knock-down configuration. This is important in the ultimate use of the bag in many applications as it causes the bag to assume an open configuration which will facilitate loading of the bag.

With reference to FIG. 1 of the drawings, it will be seen that the first step in the method of forming the bag comprises driving the web longitudinally of itself in a first direction and bending the web as it is driven longitudinally of itself to an open U-shaped configuration. Thereupon, as illustrated in FIG. 3 of the drawings, the main panels 32 are supported in the open U-shaped configuration and the side closure forming panels are folded toward one another to locate the adhesive bands at the marginal edge thereof in an overlapping relationship and thereby secure the side walls in the inwardly folded position. Thereafter the flaps which project from the bottom wall are folded inwardly into a face-to-face relationship with respect to the side walls to be adhesively secured as shown in FIG. 6. The bag forming length, having previously been severed from the coil, is discharged in the open configuration shown in FIG. 4 without any folds or creases which will encourage it to move to a knock-down or lay-flat configuration.

Several modifications of the bag and its method of manufacture will be apparent to the individual skilled in the art. For example, the side wall forming portions projecting from the bottom wall 36 may be folded inwardly before the side wall forming portions 34*a* and 34*c* are folded inwardly. In this modification, the adhesive band 20 extending across the outer surface of the tab 42 would engage the adhesive band 22 on the inner face of the side wall forming portions 34a to secure the tab 42 and its associated side wall closure members with respect to the side walls of the bag.

Apparatus

A machine for forming a bag is illustrated in FIGS. 7 to 12 of the drawings.

Former and Web Feeding Belts

Figure 7:
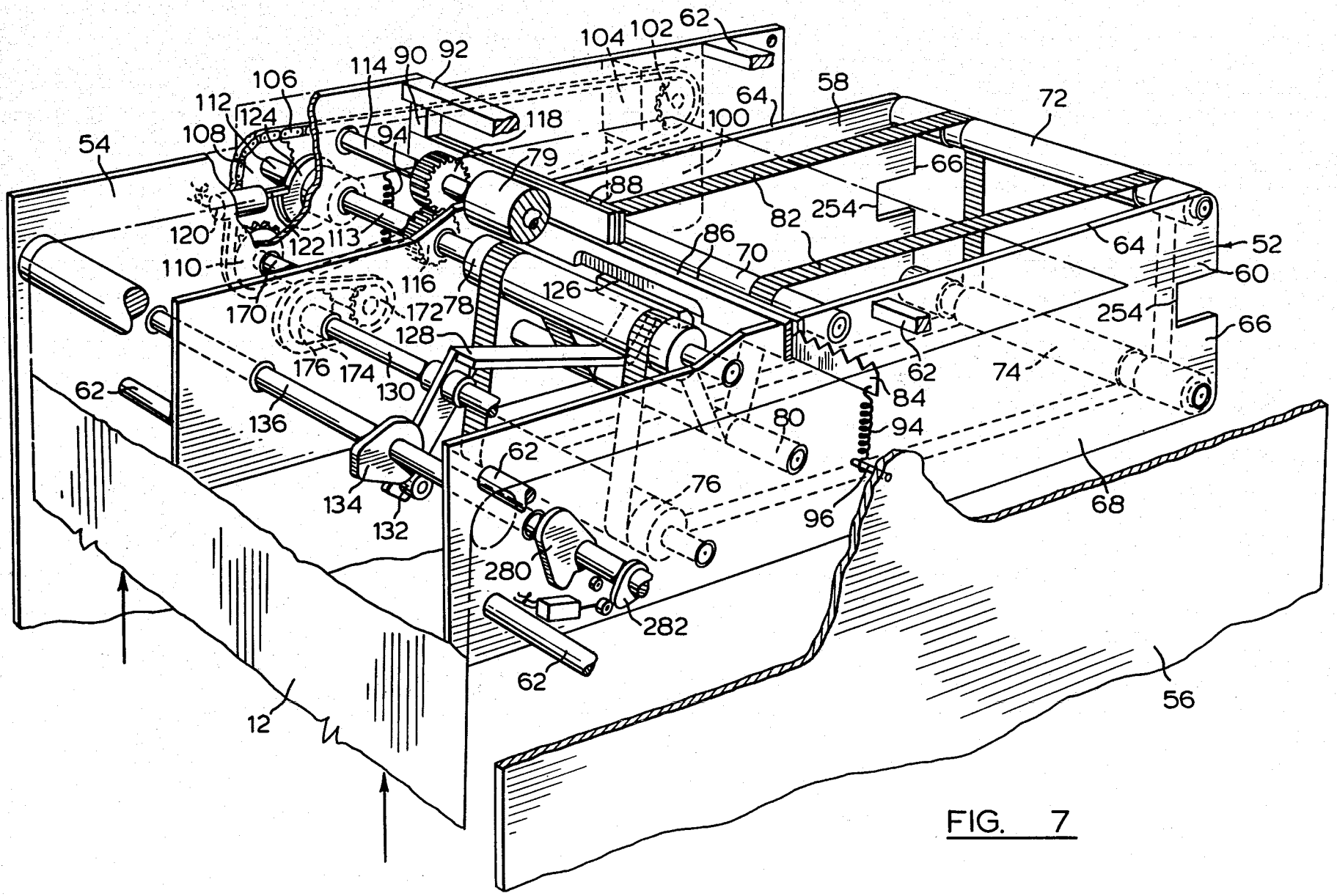
FIG. 7 is a partially sectioned pictorial view of a bag forming machine constructed in accordance with an embodiment of the present invention with certain elements removed for convenience of illustration of the former about which the web is guided.

With reference to FIG. 7 of the drawings, it will be seen that a mandrel of former 52 is supported between plates 54 and 56 of a frame in a generally horizontal plane. The former 52 consists of former plates 58 and 60 which are supported on arms 62 projecting from the plates 54 and 56 of the frame. The former plates 56 and 58 each have a bag forming portion at one end thereof which has a first folding edge 64, a second folding edge 66 and a third folding edge 68. The former plates 58 and 60 are spaced from one another a distance substantially equal to the width of the front, bottom and back panels of a bag to be formed thereon. The former plates 56 and 58 are spaced from one another by means of a plurality of spacer shafts on which guide rollers are mounted. A first guide roller 70 extends transversely between the plates 58 and 60 adjacent the input end of the guide path, the inner periphery of which is joined by the folding edges 64, 66 and 68. A second guide roller 72 extends transversely between plates 58 and 60 at the corner formed between forming edges 64 and 66 and a third guide roller 74 extends between the plates 58 and 60 at the corner formed between forming edges 66 and 68. A fourth guide roller 76, a fifth guide roller 78 and a sixth guide roller 80 are located forwardly from the bag forming portion of the former plates. A pair of endless conveyor belts 82 extend around the first, second, third, fourth, fifth and sixth guide rollers. The fifth guide roller 78 also acts as a drive pulley for driving the belts 82 around the former and is formed with teeth in the pulley recess to drivingly engage the teeth of the belts 82. In extending between the first and second guide rollers 70 and 72, the conveyor belts 82 extend along the guide path in substantially the same plane as the first folding edges 64. Similarly, in extending between the second and third guide rollers and in extending between the third and fourth guide rollers, the conveyor belts 82 extend in the planes of the second folding edges 66 and the third folding edges 68, respectively, so that as will be described hereinafter the belts 82 may serve to drive an unwinding web around the former.

Web Cutting Mechanism

In order to sever a bag forming length of web from the endless coil of web material, a cutter assembly is provided between the fifth and first guide rollers 78 and 70. The cutter assembly consists of a cutter blade 84 mounted to reciprocate vertically between a pair of guide plates 86 and complementary cutter elements 88 which are spaced above the guides 86 to limit upward movement of the web to facilitate cutting of the web by the cutter blade 84. The complementary support elements 88 are carried by arms 90 which depend from a beam 92 which extends transversely between plates 54 and 56 of the frame. The cutter blade 84 has extension springs 94 at either end thereof secured to pins 96 carried by plates 54 and 56. The extension springs 94 act as return springs serving to retain the cutter blade 94 in the lowered position when inactive. The cutter blade 84 has teeth which are V-shaped so that they can be driven directly through the web without any lateral movement being required. This is of considerable importance as it enables the drive mechanism for the cutter blade to be in the form of a simply vertically reciprocating lever.

The operation of the cutter blade mechanism is best illustrated in FIG. 7 of the drawings wherein it will be seen that cutter blade 94 is supported on a cross bar 126 which is mounted on the end of a rocker arm 128 which is in turn mounted to rock on shaft 130 which extends between former plates 58 and 60. A cam follower 132 is located at the other end of the rocker arm 128 and is positioned to be engaged by a cam 134 mounted on shaft 136. Rotation of shaft 136 which is effected, as will be described hereinafter causes the cam 34 to move the rocker arm 128 about the shaft 130 to raise and lower the cutter blade 84 as required.

Power to Feed Conveyors

The conveyors 82 are driven during the portion of the bag manufacturing cycle that is employed to feed a bag-forming length around the former 52 to the U-shaped configuration. The conveyors 82 are stationary when the folding of the sides of the web take place and when the bag is being discharged from the former.

The power source for the bag-forming machine is a motor 100 which drives a sprocket 102 through a reduction gear unit 104. The sprocket 102 drives a chain 106 around sprockets 108 and 110. The sprocket 108 is keyed to a shaft 112 which is connected through a clutch 124 to a shaft 113 on which a fifth guide roller 78 is mounted to be driven thereby. When the clutch 124 is released the shaft 113 is coupled to the shaft 112 and is driven thereby. When the clutch 124 is engaged the shaft 112 is rotatably driven while the shaft 113 remains stationary. The operation of the clutch is regulated by a solenoid valve 120 which has arm 122 projecting outwardly therefrom to engage a control flange extending from the clutch. When the arm 122 is in the extended position engaging the flange of the clutch, the shaft 112 is out of engagement with the shaft 113. When the arm 112 is withdrawn by the solenoid the shaft 112 is coupled in driving engagement with the shaft 113 by means of the clutch 124.

The fifth guide roller 78 is also a pinch roller which cooperates with the second pinch roller 79 mounted on shaft 114. A gear 116 on shaft 113 is meshed with the gear 118 on shaft 114 and serves to rotatably drive the shaft 114 which in turn rotatably drives the pinch roller 79. The pinch rollers 78 and 79 must be driven for a period of time sufficient to cause the unwinding web to be driven around the former to the U-shaped configuration shown in FIG. 8. The period of time during which the feed conveyor mechanism is operably driven is controlled by a cam 280 which is mounted on shaft 136 which engages a control switch 284 (FIG. 10). The control switch 284 controls the operation of the solenoid 120 so that when the control switch 284 is engaged by the cam 280, the solenoid is activated to withdraw the arm 122 to permit the shaft 113 to be driven by the shaft 112. When the cam 280 moves out of engagement with the control switch 284 the solenoid 120 releases the arm 122 which moves into engagement with the clutch 124 and disconnects the driving engagement between the shafts 112 and 113 so that the conveyors come to rest.

Guide Around Former

While the former 52 serves to provide an internal guide and support for the web and the conveyor 82 serves to provide a drive mechanism for driving the web around the former, it will be apparent that the web will not follow the contour of the former unless a guide mechanism is provided for engaging the external surface of the web and guiding it around the former.

Figure 8:
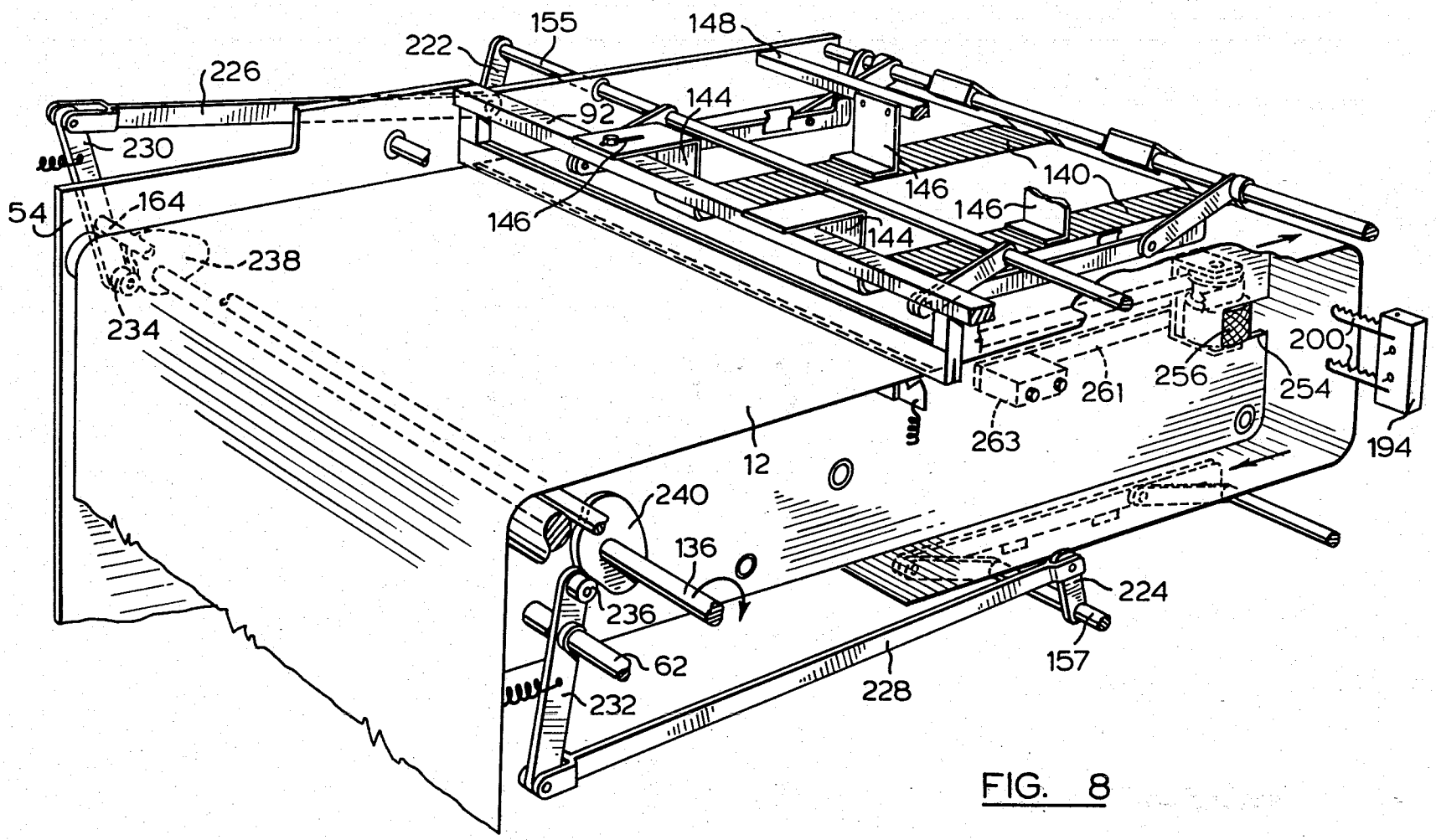
FIG. 8 is a view similar to FIG. 1 showing a web in position wound around the former with the associated guide rails in position.

With reference to FIGS. 8 and 12 of the drawings, it will be seen that the guide mechanism for guiding the unwinding web in a guide path extending along the first support face of the former, around the bottom support face of the former, and along the second support face includes a first pair of flexible guide belts 140 and a second pair of flexible guide belts 142. The belts 140 and 142 are located directly outwardly from the conveyor belts 82. The leading end of each belt 140 is secured to a bracket 144 which is mounted on the transversely extending member 92, adjustment being provided by a longitudinal slot 146 provided in the bracket 114. Similarly one end of each guide belt 142 is mounted on a bracket 144 which is secured to a transverse member of the frame (not shown). Brackets 146 are mounted on transverse support member 148 and extend toward the belts 140 and 142 and are spaced from the brackets 144 and serve to maintain a substantial length of each belt 140 and 142 in the plane of its associated run of the conveyor 82. The other end of each belt 140 is mounted on a bracket or gate 150 and the other end of each belt 142 is mounted on a bracket or gate 152 (FIG. 12). The gates 150 and 152 are pivotally mounted on shafts 154 and 156, respectively, to pivot between the closed position shown in solid lines in FIG. 12 and the open position shown in broken lines in FIG. 12. When the flexible belts 140 and 142 are in the closed position shown in solid lines in FIG. 12, each belt extends around a corner of the former to form a substantially continuous guide path around the former. When the guide belts are in the open position, they are spaced outwardly from the former a distance sufficient to permit a bag to be discharged from the former in an open configuration.

The mechanism for moving the guide belts between the open position and the closed position is illustrated in FIG. 10 of the drawings. To avoid over complication of the drawings, only one gate opening mechanism is illustrated. However, it will be understood that the mechanism for moving the gates 150 and that used for moving the gates 152 is identical, one being located above and the other being located below the former. The mechanism which is illustrated in FIG. 10 includes a lever arm 158 which is secured to the shaft 154 on which brackets 150 are mounted. The other end of the lever arm 158 is pivotably connected to one end of a connecting rod 160. The other end of the connecting rod 160 is pivotably connected to one end of a rocker arm 162. The rocker arm 162 is mounted to pivot on shaft 164 which extends from frame plate 54. A cam follower 166 is mounted at the other end of the rocker arm 162 and is positioned to engage a cam 168 which is mounted on shaft 136. The main lobe of the cam 168 serves to retain the rocker arm 162 in the position shown in FIG. 10 which holds the gates 150 in the open position shown in FIG. 10. When the cam 166 is rotated, the rocker arm 162 will pivot about the shaft 164 to move the brackets 150 between the open position shown in FIG. 10 and the closed position shon in FIG. 12.

Main Cam Shaft

The shaft 136 is the main cam shaft from which the principal mechanical mechanisms of the machine are controlled. The drive mechanism which rotatably drives the cam shaft 136 will now be described with reference to FIGS. 7 and 10. The power source is the motor 100 which, as previously described with reference to FIG. 7, drives the sprocket 110 by means of a chain 106. The sprocket 110 is mounted on a shaft 170 which extends between frame plate 54 and former plate 58. A sprocket 172 is mounted on the other end of shaft 170 and is connected by means of a chain 174 to sprocket 176 on shaft 130. Turning now to FIG. 10 of the drawings, it will be seen that the shaft 130 has gears 178 and 180 keyed thereto. A bracket 182, which is supported by the frame, has a shaft 184 mounted for rotation therein. A gear 186 is mounted at one end of the shaft 184 and is meshed with the gear 180 and a worm 190 is located at the other end of the shaft 184 and is meshed with a worm gear 192 on cam shaft 136. Thus, the motor 100 serves to drive the main cam shaft 136.

Cutter Mechanisms

Having fed a web of bag forming material around the former to the U-shaped configuration illustrated in FIG. 8 of the drawings, the cutter blade mechanism is operated to sever the bag forming length from the continuous web and the sides of the bag are then closed. As previously indicated, a tab 42 (FIG. 1) is formed between a pair of slits 40. In order to cut the web to form the slits 40, a knife mechanism is provided at each side of the former. The knife mechanism will now be described with reference to FIGS. 9, **9*a*, 9*b* and 9*c*. It will be understood that a knife mechanism is located at each side of the former, although for simplicity of illustration only one knife mechanism is shown in FIG. 9. Each knife mechanism includes a support block 194 which, together with a further support block 196 which will be described hereinafter, is mounted on an end plate 198 carried by frame plate 56. A pair of knives 200 project outwardly from the support block 194 in a spaced parallel relationship. The support block 194 is releasably secured with respect to the face plate 198 by means of a pair of mounting screws 202. A pair of support arms 204 are mounted on the support bracket 196 and project outwardly therefrom. As shown in FIGS. 9 and 10 of the drawings, a spacer shaft 206 extends between the arms 204 and a pair of link arms 208 are mounted at opposite ends of the shaft 206 to pivot about the axis of the shaft 206. A shaft 210 extends between the link arms 208 intermediate the ends thereof and a roller 212 extends between the inner ends of the link arms 208 and is rotatable about its longitudinal axis. Two pairs of shear guide plates 213 are mounted on each shaft 210 to be movable therewith toward and away from a knife 200 to move a portion of a web located therebetween into engagement with the knives 200 to cut the web to form the slits 40**.

Folding Mechanism

Having formed the tabs 42, it is necessary to fold the side panels inwardly about the former. The folding mechanism will now be described with reference to FIGS. 8, 9 and 10 of the drawings.

As best shown in FIG. 9 of the drawings, four shafts 154, 155, 156 and 157 extend transversely between frame plates 54 and 56. Lever arms 214 are secured to shafts 155 and 157 for movement therewith and lever arms 216 are pivotably mounted on shafts 154 and 156. The lever arms 214 and 216 are pivotably connected at their inner ends by a folding arm 218. It will be noted that each folding arm 218 has an end portion 220 projecting from the arm 216 toward the bottom support face of the former. The outer extremity of the end portions 220 are elongated vertically so that as they are driven toward the plane of the bottom panel they do not damage the web. The lever arms 214 and 216 are retained by the folding arm 218 so as to extend parallel to one another so that by rocking the shafts 155 and 157, the folding arms 218 will remain parallel to one another while being moved towards and away from one another in an action plane spaced outwardly from and parallel to the former plates 58 and 60.

Spring finger plates 219 are mounted on each folding arm 218 and project inwardly therefrom toward the former plates 58 and 60. In use the plates 219 apply a pressure to the side forming panels of the web which helps to maintain these panels in the overlapping relationship when the discharge load is applied to the bag to drive it from the mandrel. The plates 219 retard the forward motion of the side panels in a plane spaced from the plane of engagement of the discharge rollers and this draws the side panels toward one another during discharge.

The folding arms 218 are movable between the innermost position shown in FIG. 9 and the outermost position shown in FIG. 8 by a drive mechanism shown in detail in FIG. 8. The drive mechanism includes lever arms 222 and 224 which are secured to shafts 155 and 157 respectively. A connecting rod 226 has one end secured to the outer end of the lever arm 222 and a connecting rod 228 has one end connected to the outer end of lever arm 224. The other end of the connector rod 226 is connected to rocker arm 230 and the other end of connector rod 228 is connected to rocker arm 232. The rocker arm 230 is mounted for rotation on an extension of the shaft 164 which projects outwardly from the frame plate 54 and the rocker arm 232 is mounted for rotation relative to shaft 62. Cam followers 234 and 236 are located at the other ends of rocker arms 230 and 232 respectively and engage cams 238 and 240 respectively which are mounted on and driven by cam shaft 136. Thus, it will be seen that one full rotation of the cam shaft 136 will move the folding arms inwardly from the position shown to the position shown in FIG. 9 and outwardly once again to the position shown in FIG. 8.

From the profile of the cams 238 and 240 it will be apparent that in each complete cycle there are times when the arms are in their outermost position and their innermost position and there are also times when the arms are in an intermediate position. It will also be understood that the position of the cams on the shaft 136 is such that the lower folding arm operates to fold the lower side panel inwardly before the upper folding arm operates to fold the upper side panel inwardly.

A mechanism is also provided for folding the portion of the web which projects outwardly from the bottom wall forming portions into an outwardly overlying relationship with respect to the side walls. A major portion of this mechanism has previously been described in describing the operation of the knife mechanism used for forming the slits 40. As previously indicated, a roller 212 is mounted at the outer end of link arms 208 which are pivotable about the axis of the shaft 206. It is the movement of the roller 212 from its outwardly spaced position shown in FIG. 9 to its inner position shown in FIG. 10 which folds the portion of the web which projects from the bottom wall panel into an outwardly overlying relationship with respect to the side wall of the bag. The mechanism for effecting movement of the roller 212 between the position shown in FIG. 9 and FIG. 10 of the drawings includes a connecting rod 242 which has one end connected to the shaft 210 and its other end connected to a rocker arm 244. A cam follower 246 is located at the other end of the rocker arm 244 in engagement with a cam 248. A connecting rod 243 is connected to the shaft 210 associated with the other roller 212 and is pivotally connected to a lever arm 245 which is secured to the shaft 62 for movement with the shaft 62 as is the rocker arm 244. A return spring 250 extends between one arm of the rocker arm 244 and a support pin 252 which is secured to the frame. The return spring 250 serves to urge the mechanism supporting rollers 212 to the outwardly spaced position illustrated in FIG. 9 of the drawings.

Discharge Mechanism

Having described the elements of the mechanism required to fold the web to form the bag about the former, the discharge mechanism for discharging the bag from the former will now be described.

As shown in FIGS. 7 and 8 of the drawings, rectangular shaped opening 254 is formed in the former plates 58 and 60 adjacent the bottom wall forming edge thereof. With reference to FIGS. 8 and 11 of the drawings, it will be seen that a roller 256 is mounted inwardly of each of the plates 58 and 60 and has a peripheral edge portion projecting through the opening 254. The rollers 256 are keyed to support shaft 258 which is journalled i a support bracket 260 which is mounted on the free end of a support arm 261 the other end of which is mounted on a bracket 263 which is secured to the adjacent former plate (FIG. 8). The arms 261 are sufficiently flexible to enable the rollers 256 to be self-aligning with respect to the roller 212 and to accommodate limited movement of the rollers 256 away from and towards the rollers 212. The rollers 256 are urged away from one another by an expansion mechanism 265 which includes shafts 267 and 269 which are telescoped one within the other and compression spring 273 which reacts against heads 271 at the free end of each shaft 267 and 269.

A drive pulley 262 is mounted to drivingly engage each shaft 258. The pulleys 262 are each driven by a drive belt 264 which, as shown in FIG. 10 of the drawings, extend around pulleys 266 which are drivingly mounted on shafts 268. The shafts 268 are supported by the frame for rotation about their axes, the supports for the shafts 268 being eliminated from FIG. 10 of the drawings so as to avoid over complication of the mechanism illustrated. Gears 270 are mounted on each shaft 268 to mesh with the gears 178 and 180 which are rotatably driven by shaft 130 as previously described. Thus, the discharge rollers 256 are driven by the motor 100 through the power train previously described. It will, however be apparent that the discharge rollers 256 are only capable of drivingly engaging the bag when the folding rollers 212 are located in the inner position illustrated in FIG. 11.

As a bag is discharged from the former the crease lines 39 are formed by the rollers 212 bearing against the edges of the former. With reference to FIG. 11 of the drawings, it will be seen that each of the rollers 212 has an angularly inclined shoulder 215 at each end thereof projecting radially outwardly to a cylindrical surface 213 of greater diameter than that of the main body of the roller 212. A resilient collar 211 and a flexible lip 217 are mounted in a recess formed in the roller 212 and cooperate with the side edges 64 and 68 of the former to form a sharp crease along edges 39 without damaging the bag as it is discharged from the former.

Unwinding Mechanism

To permit a changeover from one coil of bag forming material to another, two unwinding support shafts are provided. As shown in FIG. 12 of the drawings, one of the support shafts is identified by the reference numeral 290 and the other is identified by the reference numeral 292. These shafts may be supported by the frame or they may be mounted on self-supporting support stands. At the input end to the former, a roller 77 is mounted for rotation on the outer end of a pair of lever arms 294 (shown in broken lines). The other ends of the lever arms 294 are pivotally mounted for rotation about the axis of a shaft 296. A control lever 298 projects outwardly from the shaft 296 and is operable to move in the directions of the arrows shown in FIG. 12 to move the roller 77 between a position in which it will cooperate with the roller 78 to drive a web therebetween or a position in which it will cooperate with the roller 79 to drive a web therebetween. In the embodiment shown in FIG. 12, a web 12 is being unwound from a first coil 10 around guide rollers 300 and 302, along a platform 304 to be driven by pinch roller 78 and pressure roller 77. When all of the web has been unwound from the coil 10, the control lever 298 may be moved to a position in which the pressure roller 77 engages the web **12*a* and begins to unwind the web 12*a* from the coil 10*a* around guide rollers 299, 300*a*, 302*a***. Thus, it is possible to replace a coil without disrupting the operation of the bag forming machine.

Method of Operation

The bag forming machine described above can be set up so as to proceed from the starting configuration illustrated in FIG. 12 of the drawings to the point where a bag is discharged in an open configuration by following one or other of several sequences. The following description of the method of operation refers to one such sequence in which after an initial set-up, the bag forming machine comes to rest in a position ready to effect an immediate discharge of a bag in the open configuration from the former and to simultaneously commence the forming of a subsequent bag to the configuration of the bag which is in the process of being discharges.

Thus, with reference to FIG. 12 of the drawings, when the two rolls of bag forming material have been mounted as previously described and the control lever 298 set to unwind the first web, the operator will activate the bag forming mechanism, generally by means of a foot pedal or the like, to cause the motor 100 to drive the power train. Initially, the discharge rollers 256 will be driven while the feeding conveyors 82 and the pinch rollers will be retained in a stationary condition by the solenoid controlled clutch 124. After a period of time sufficient to permit discharge of a bag from the former, if a bag had been located on the former, the feed mechanism will be activated as will be described hereinafter to feed a web around the former.

The knife 84 is then activated to cut the bag forming length from the web and the folding arms are also activated to fold the side forming panels inwardly to the overlapping position. The power to the motor 100 is then interrupted so that the mechanism remains in a "hold" position in which the web is folded to the required bag configuration but the seal is not totally made until the bag is discharged.

The sequence of events is best illustrated by reference to FIG. 13 of the drawings in which the outermost track 300 diagrammatically illustrates the operation and timing of the discharge mechanism and the cutter mechanism for cutting the slits 40. The second track 302 diagrammatically illustrates the timing and operation of the main cutter blade and the movement of the gates 150 between the open and closed positions. The track 304 illustrates the timing and operation of the feed mechanism and the operation of the lower fold arm.

Track 306 illustrates the timing and operation of the upper fold arm.

As previously indicated, after the initial set-up, the machine is in the position in which a bag is substantially fully formed on the former but is not totally sealed. This position is represented by the zero degree (0°) marking on FIG. 13. The sequence of events in the operation of the machine can best be described by proceeding to read the diagram illustrated in FIG. 13 in a counterclockwise direction. When the operator activates the mechanism which is in effect a demand for the production of an open bag, power is supplied to the motor 100 and as shown between the 20° and 40° positions of FIG. 13 the discharge roller 212 is moved to its innermost position in which it will press the bag into driving engagement with the discharge rollers 256. Simultaneously, the gates 150 will move to the open position. As shown in track 304, the upper and lower folding arms will remain in their lowermost position for a short period of time after the initial movement of the discharge rollers 212. This period of time is sufficient to enable the discharge rollers to move sufficiently close to the sides of the bag to prevent the side forming panels moving away from the former. Thereafter, the upper and lower folding arms will be withdrawn to an intermediate position which they assume at the 40° position. Between the 40° position and a position at about 130°, the discharge mechanism is fully operative and the gates 150 are fully open and a bag is in the process of being discharged and sealed by engagement of the seal line between rollers 256 and 212. At about 130° displacement, the upper and lower folding arms are raised clear of the guide track of the former so as to be out of the path of the feed of the next bag. At the 160° displacement position, the fully formed bag has been discharged from the former and the rollers 212 begin to move away from the rollers 256 and continue to do so until about the 200° mark. At the same time, the gates 150 begin to move inwardly to move the guide belts 140 and 142 to a position to guide the web around the former. At about 180° displacement, the solenoid valve 120 is activated to release the clutch 124 to permit the feed mechanism to operate to drive the unwinding web around the former. The feed mechanism is operational up to about the 255° position whereupon the solenoid valve 120 is again activated to operate the clutch 124 to interrupt the power supplied to the feed mechanism. At about the 250° position, the mechanism which supports the side cutters is activated to move to engage the web and form the slits 40, the slits being completed at the 280° mark whereupon the mechanism is partially retracted. As shown with reference to track 302, the main cutter blade mechanism is activated between the 280° mark and the 340° mark to cut the bag forming length from the continuous web. Simultaneously, between the 280° mark and the 320° mark, the lower fold arm is moved to its innermost position thereby folding the lower side wall forming portion inwardly about the former. At about the 300° mark, the upper fold arm begins to move inwardly and continues to do so to about the 350° mark to fold the upper side wall forming portion inwardly to an outwardly overlying relationship with respect to the lower side wall forming portion and thereafter the mechanism comes to rest at the 0° position. This is achieved by the cam 282 activating the switch 286 to disrupt the power supplied to motor 100 causing the mechanism to come to rest in the holding position.

From the foregoing, it will be apparent that the present invention provides a simple and efficient apparatus for forming a bag. While it is to be understood that various modifications of the apparatus will be apparent to those skilled in the art, there are a number of features of the apparatus described in the preferred embodiment which are particularly advantageous.

An example of a particularly advantageous feature of the apparatus of the present invention is the fact that the mechanism is largely mechanical so that it is capable of being serviced by a mechanic having only a basic knowledge of mechanical mechanisms. Furthermore, all of the mechanical controls are effected from a single cam shaft.

In tests carried out with a test model of this apparatus, difficulty was experienced in discharging the bags from the former. The difficulty appeared to result from the fact that while the discharge rollers were initially required to engage the sides of the bag which are several layers thick, as shown in FIG. 6, the rollers subsequently move to engage the web of the thickness of the overlap. Initially, the discharge rollers 256 were mounted on fixed bearings located on the former plates. With this construction, although a bag could be formed without difficulty, the appearance of the bag was, on occasion, adversely affected by relative movement occurring between the oppositely disposed side panels at the overlap. It was found that by mounting the rollers 256 so that they are able to float and are self-aligning, this difficulty has been largely overcome.

A further difficulty which was experienced in preliminary tests was in maintaining the overlapping relationship at the side walls until the bag was fully discharged. It was found that there was a tendency for the overlapping edges to move away from one another when the discharged load was applied between the discharge rollers 212 and 256. This difficulty has been overcome by the simple expedient of providing the spring biasing fingers 219 on each of the folding arms 218. The fingers 219 press against the side wall forming portions of the bag above the plane of the overlap so that when a discharging load is applied in the plane of the overlap, the movement of the bag in the area underlying the pressure fingers 219 in a direction towards the discharge is retarded, thus tending to direct the overlapping edges inwardly toward the overlapping relationship.

The edges 64, 66 and 68 of the former plates 58 and 60 perform the dual function of providing a guide rail about which an unwinding web may be directed and a folding edge about which the side wall forming panels may be folded inwardly. The guide rollers 72 and 74 provide an arcuate surface about which to bend the web as it is driven along the guide path without weakening the web as a result of bending thereabout. The endless conveyors 82 preferably have a ridged underface which engages ridges formed in the base of the various grooves in the various rollers about which they extend so that the rollers are positively driven.

It will be noted that while many of the elements of the bag forming machine are movable, the former is itself stationary. One of the advantages to a stationary former is that the space occupied by the machine need be only slightly greater than the overall proportions of the former. In many applications such as the installation of a device of this type in a check-out counter, space is at a premium and it is, therefore, important to minimize the size of the bag forming machine. In preliminary work, the applicant did develop machines in which the former was movable. However, such machines were quite large by reason of the need to provide space for accommodating movement of the former.

The use of flexible belts to form the outer guide members considerably simplified the construction of the outer guide. Considerable difficulty was experienced in attempting to devise a mechanism which would provide a guide for guiding the web around the bottom wall forming portion of the former but which would also permit discharge of the formed bag from the stationary former. This difficulty was overcome by using the flexible guide belts 140 and 142 and extending these belts around the corners formed at the bottom wall forming portion and mounting the outer end thereof on the movable gates. By combining the discharge mechanism with the sealing mechanism, the present apparatus permits the rollers which are used to engage opposite sides of the bag to discharge it from the former to drive the discharging bag so that the overlapping edges of the web along which a seal is to be formed are driven between the discharge rollers so that the overlapping edges are pressed together by the discharging rollers to form an efficient seal. Simultaneously with the discharging, a crease line is formed between one of the discharge rollers 212 and the edge of the former so that when the bag is discharged from the former it will automatically assume and retain the open configuration and will have no memory tending to urge the bag towards a lay-flat or knock-down configuration.

In the method of forming the square bottom bag by means of the apparatus of the preferred embodiment, it will be noted that while the web is subjected to bending about the rollers 72 and 74 to the U-shaped configuration, this bending does not form any permanent crease lines which would weaken the structure of the bottom of the bag. This has the advantage that the strength of the bottom of the bag thus produced is greater than that produced by the conventional bag forming methods in which the web is creased to enable it to be stored in a knock-down configuration. Tests have indicated that a square bottom bag constructed by the method described and the apparatus of the preferred embodiment using a conventional paper bag roll stock of the type commonly used for packaging groceries will maintain its open configuration when discharged so that it is open to facilitate loading with groceries or the like.

Various modifications of the present invention will be apparent to those skilled in the art. One modification is illustrated in FIGS. 14 and 16 of the drawings. As shown in FIG. 14 of the drawings, a band 22 of a thermosetting adhesive or a radiation sensative adhesive is applied to the outer face 16 of the web 12 at the marginal edge of the side closure forming portions 34. It should be noted that no adhesive band is applied to the inner face 18 of the web 12. In order to form a seal, the side wall forming portions 34 are folded inwardly so that the marginal edge of the upper side wall forming portion is located in an outwardly overlying relationship with respect to the marginal edge of the lower side wall forming portion. In this position, the band of adhesive 20*a* which is applied to the marginal edge portion of the lower side wall forming wall member is in intimate contact with the inner surface of the opposite side wall forming portion 34. Thereafter, the bottom corner flap 35 is folded inwardly to the position shown in FIG. 16. The critical areas of the heat sensitive adhesive are then activated to bond the overlying portions of the side wall closure members together in the configuration shown in FIG. 16. It will be noted that the portion of the adhesive band 20 which is located on the external surface of the side wall after folding to the position shown in FIG. 15 serves to secure the end flap 35 in the inwardly folded position. Thus, it will be seen that a bag may be constructed in which the adhesive is in the form of a thermosetting adhesive or an adhesive of a type which is activated by radiation of one form or another. A bag may be constructed in this configuration in the apparatus previously described by the addition of a heat sealing element upstream from the sealing and dispenser rollers. Alternatively, the sealing rollers may be heated to an extent sufficient to cause the bands of adhesive 28 to be activated during discharge of the bag from the former.

While it is possible to use adhesives which are activated by one form of radiation or another such as thermal radiation, there is a substantial advantage to the use of the pressure sensitive adhesive of the type described in the embodiment illustrated in FIGS. 1 through 6 of the drawings. The pressure sensitive adhesive does not require a radiation or heating device to be present in the bag forming apparatus and, provided adequate pressure is applied, it is not necessary to provide a minimum dwell time in order to achieve the required adhesion. On the other hand, the use of the heat sensitive or radiation sensitive adhesive may serve to eliminate the need to provide the adhesive at both the inner and outer faces of the web so that there may be a saving in the amount of adhesive used.

The present invention provides a method and apparatus for manufacturing a bag which is discharged in an open configuration. The method and apparatus are so simple that the operation of making a bag may be carried out by the end user rather than by a converter. Thus, the packer may simply stock a supply of roll stock and manufacture bags as required from the roll stock. This reduces the volume of material which must be stocked by the packer.

In the foregoing disclosure, reference has been made to the fact that the cutter mechanism for severing the bag forming length from the continuous web includes a cutter blade which has a plurality of V-shaped teeth which are driven directly through the web. As previously indicated, this mechanism has the advantage that it requires a minimal amount of space. A further advantage of this mechanism is that in cutting through the web, the teeth form an irregular edge across the web. This is in contrast to the very sharp edge which is formed by a knife such as a guillotine. This is extremely important in the manufacture of bags which are to be manually loaded in which the operator is required to pass his hand or arm through the open end of the bag during the loading operation. A sharp edge on a bag such as a grocery bag would represent a substantial hazard to the packer.

In the preceding disclosure the advantages to be derived from the fact that the bottom of the bag is not creased to the extent required with conventional bags have been discussed at length. In the conventional knock-down paper bag it is necessary to form a 360° fold along the edges of the bottom wall panel so that the bag can lay flat for storage purposes. This 360° fold causes a considerable number of the fibres of the body of a web of paper material to break. thus weakening the paper bag. In certain applications it may be desirable to form a fold line between the front, back and bottom walls of a bag constructed in accordance with an embodiment of the present invention to assist in the formation of a flat bottom wall which will provide a stable support for the empty bag. In the construction of a bag according to the methods described hereinbefore it is only necessary to form a 90° fold between the front, bottom and back walls as the bag is discharged in the open configuration, thus the folding does not damage the fibre structure of the web to the extent required to obtain a lay flat configuration.

These and other advantages of the method and apparatus of the present invention will be apparent to those skilled in the art.

We claim:

1. A paper bag forming roll stock comprising a longitudinally elongated web of bag forming paper having an inner face and an outer face, a pair of oppositely disposed side edges and a marginal edge portion extending inwardly from each of said side edges, said web having a uniform thickness across its full width, said web being wound onto a roll with said inner and outer faces aligned in face-to-face contact with one another, a first pair and a second pair of bands of cohesive-adhesive material, one of said pairs of adhesive bands being applied to and extending continuously in a straight path longitudinally of the web along said inner face and the other pair being applied to and extending continuously in a straight path longitudinally along the outer face of the web, each of the adhesive bands of the first pair being located within a different one of the marginal edge portions on the one face of the paper and spaced inwardly from the adjacent side edge, and each of the bands of said second pair being located within a different marginal edge portion on the other face of the paper and spaced inwardly from the adjacent side edge by a distance which is greater than the spacing of the inner edge of the underlying first band whereby the bands of the pairs are laterally offset so as to be out of alignment with one another in successive turns of said roll such that the successive turns are not adhesively secured to one another.

2. A roll stock as claimed in claim 1, wherein each of the bands of the pair of adhesive bands which are located on the outer face of the paper on the roll are substantially wider than the bands of the pair located on the inner face of the paper.

* * * * *